US009951715B2

(12) United States Patent
Scharp

(10) Patent No.: US 9,951,715 B2
(45) Date of Patent: Apr. 24, 2018

(54) SUB-ASSEMBLY CONSISTING OF A PISTON AND AN INJECTION NOZZLE FOR AN INTERNAL COMBUSTION ENGINE

(71) Applicant: Mahle International GmbH, Stuttgart (DE)

(72) Inventor: Rainer Scharp, Vaihingen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 14/913,660

(22) PCT Filed: Aug. 22, 2014

(86) PCT No.: PCT/DE2014/000421

§ 371 (c)(1),
(2) Date: Feb. 22, 2016

(87) PCT Pub. No.: WO2015/024551

PCT Pub. Date: Feb. 26, 2015

(65) Prior Publication Data

US 2016/0208734 A1 Jul. 21, 2016

(30) Foreign Application Priority Data

Aug. 23, 2013 (DE) ..... 10 2013 013 962

(51) Int. Cl.
*F01P 1/04* (2006.01)
*F02F 3/22* (2006.01)
(Continued)

(52) U.S. Cl.
CPC ..... *F02F 3/22* (2013.01); *F01P 3/08* (2013.01); *F01P 3/10* (2013.01)

(58) Field of Classification Search
CPC ..... F02F 3/22; F01P 3/08; F01P 3/10
(Continued)

(56) References Cited

U.S. PATENT DOCUMENTS 4,286,505 A * 9/1981 Amdall ..... F02F 3/0015 123/41.35
4,831,917 A * 5/1989 Houben ..... F02B 23/0696 123/193.6

(Continued)

FOREIGN PATENT DOCUMENTS

DE 2007801 A1 9/1971
DE 3717767 A1 12/1988

(Continued)

OTHER PUBLICATIONS

English abstract for JP-11132101.
German Search Report for DE-102013013962.7, dated Mar. 5, 2014.
English abstract for DE-102006056011.

*Primary Examiner* — Marguerite McMahon
(74) *Attorney, Agent, or Firm* — Fishman Stewart PLLC

(57) ABSTRACT

A sub-assembly may include a piston and an injection nozzle for cooling oil for an internal combustion engine. The piston may have a piston skirt and a piston head, where the piston may have a piston crown with an underside, a circumferential ring part, and in the region of the ring part, a circumferential cooling channel with at least one feed opening for the cooling oil. The piston may also have a jet divider for the cooling oil on the underside of the piston crown adjacent to the at least one feed opening. The injection nozzle may be arranged below the jet divider and may be oriented toward the jet divider.

20 Claims, 3 Drawing Sheets

(51) Int. Cl.
*F01P 3/08* (2006.01)
*F01P 3/10* (2006.01)

(58) Field of Classification Search
USPC ..... 123/193.6, 41.35
See application file for complete search history.

(56) References Cited

U.S. PATENT DOCUMENTS

| | | | | |
|---|---|---|---|---|
| 4,947,805 | A | 8/1990 | Steppat et al. | |
| 5,595,145 | A * | 1/1997 | Ozawa | F02F 3/22 123/41.35 |
| 5,730,090 | A * | 3/1998 | Kling | F01P 3/08 123/41.35 |
| 5,778,533 | A | 7/1998 | Kemnitz | |
| 5,890,416 | A | 4/1999 | Thieme et al. | |
| 7,240,643 | B1 * | 7/2007 | Perr | F01P 3/08 123/41.35 |
| 2002/0139322 | A1 * | 10/2002 | Murglin | F01M 1/08 123/41.35 |
| 2003/0221639 | A1 | 12/2003 | Weng et al. | |
| 2005/0092265 | A1 * | 5/2005 | Dunbar | F01M 1/08 123/41.35 |
| 2006/0118076 | A1 * | 6/2006 | Schnaitmann | B22C 9/105 123/193.6 |
| 2011/0265743 | A1 * | 11/2011 | Ask | F01P 3/10 123/41.35 |
| 2013/0180493 | A1 * | 7/2013 | Kaiser | B21K 1/18 123/193.4 |

FOREIGN PATENT DOCUMENTS

| | | | |
|---|---|---|---|
| DE | 4446726 | A1 | 6/1996 |
| DE | 19703001 | A1 | 8/1998 |
| DE | 202006020280 | U1 | 2/2008 |
| DE | 102006056011 | A1 | 5/2008 |
| JP | 11132101 | | 5/1999 |
| WO | WO-89/04916 | A1 | 6/1989 |
| WO | WO-2007/063899 | A1 | 6/2007 |
| WO | WO-2011/105374 | A1 | 9/2011 |

* cited by examiner

SUB-ASSEMBLY CONSISTING OF A PISTON AND AN INJECTION NOZZLE FOR AN INTERNAL COMBUSTION ENGINE

CROSS-REFERENCE TO RELATED APPLICATIONS

This application claims priority to German Patent Application No. 10 2013 013 962.7, filed Aug. 23, 2013, and International Patent Application No. PCT/DE2014/000421, filed Aug. 22, 2014, both of which are hereby incorporated by reference in their entirety.

TECHNICAL FIELD

The present invention relates to a sub-assembly comprising a piston and an injection nozzle for cooling oil for an internal combustion engine, the piston having a piston head and a piston skirt, the piston head having a piston crown with an underside, a circumferential ring part and, in the region of the ring part, a circumferential cooling channel with at least one feed opening for cooling oil, the injection nozzle being provided below the piston skirt.

BACKGROUND

The sub-assembly of the generic type is a piston with injection cooling, that is to say the piston is cooled by way of the injection with cooling oil from the piston skirt-side end in the direction of the at least one feed opening for cooling oil in the cooling channel. The cooling oil penetrates into the cooling channel and brings about cooling of the piston there in a manner known per se, in particular in the region of the piston head.

On account of the high thermal loading of modern pistons, it is desirable also to cool the underside of the piston crown, what is known as the "dome". To this end, DE 10 2006 056 011 A1 proposes to provide two injection nozzles for cooling oil, of which one serves to supply the cooling channel with cooling oil and the other serves to cool the underside of the piston crown.

SUMMARY

It is the object of the present invention to develop a piston of the generic type in such a way that technically simple and reliable injection cooling is achieved.

The object is achieved by virtue of the fact that the piston has a jet divider for cooling oil on the underside of the piston crown adjacently with respect to the at least one feed opening for cooling oil, and that the injection nozzle is arranged below the jet divider and is oriented toward the jet divider.

The jet divider which is provided according to the invention causes part of the cooling oil jet which is output by the single provided injection nozzle to be steered at least temporarily in a targeted manner in the direction of the underside of the piston crown, whereas the remaining part enters into the cooling channel. The sub-assembly according to the invention therefore represents a technically simple solution for reliable injection cooling.

Advantageous developments result from the subclaims.

If the center axis of the injection nozzle is oriented parallel to the center axis of the piston, the jet divider causes a division of the cooling oil jet during the entire stroke movement during engine operation into a part jet which is directed toward the cooling channel and a part jet which is steered toward the underside of the piston crown.

One particularly preferable development provides that the center axis of the injection nozzle encloses an acute angle with the center axis of the piston. This oblique position of the injection nozzle causes the entire cooling oil jet to be guided into the cooling channel during engine operation when the piston is at the top or bottom dead center, whereas the division of the cooling oil jet takes place approximately in the middle region of the stroke. The jet divider which is provided according to the invention therefore crosses the cooling oil jet precisely once during every upward and downward stroke and causes the division of the cooling oil jet into in each case one part jet which is directed toward the cooling channel and one part jet which is steered toward the underside of the piston crown.

The jet divider expediently has a substantially V-shaped cross section with the formation of an edge which, starting from the center axis, is arranged toward the outside in the direction of the cooling channel.

The jet divider which is provided according to the invention can be configured in one piece with the piston head or can be configured as a separate component which is connected fixedly to the piston head.

The jet divider particularly preferably has a first guiding face and a second guiding face, the first guiding face being assigned to the cooling channel and the second guiding face being assigned to the underside of the piston crown. It is particularly advantageous here if the first guiding face merges continuously into an inner wall of the cooling channel and/or the second guiding face merges continuously into the underside of the piston crown. Particularly reliable cooling of the underside of the piston crown is achieved in this way.

The sub-assembly according to the invention can be realized with all piston types, in particular with single-piece pistons, pistons comprising two or more components which are connected to one another, box-type pistons, pistons with a closed cooling channel, and pistons with a cooling channel which is open toward the bottom and is closed by way of a closure element, in particular pistons with a thermally decoupled piston skirt.

BRIEF DESCRIPTION OF THE DRAWINGS

One exemplary embodiment of the present invention will be explained in greater detail in the following text using the appended drawings, in which, in a diagrammatic illustration which is not to scale.

DETAILED DESCRIPTION

Figure 1:
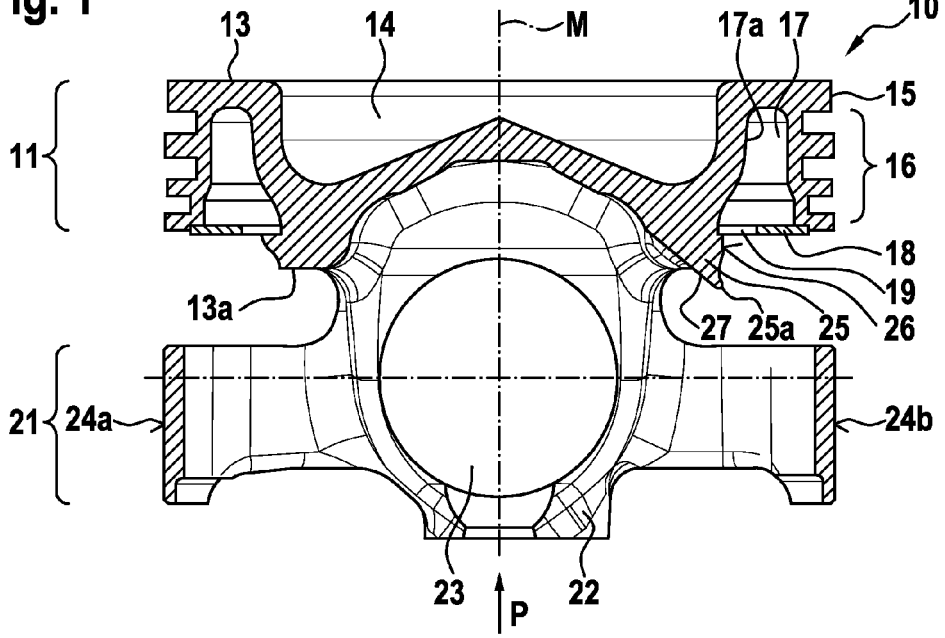
FIG. 1 shows one exemplary embodiment of a piston for a sub-assembly according to the invention in section.
Figure 2:
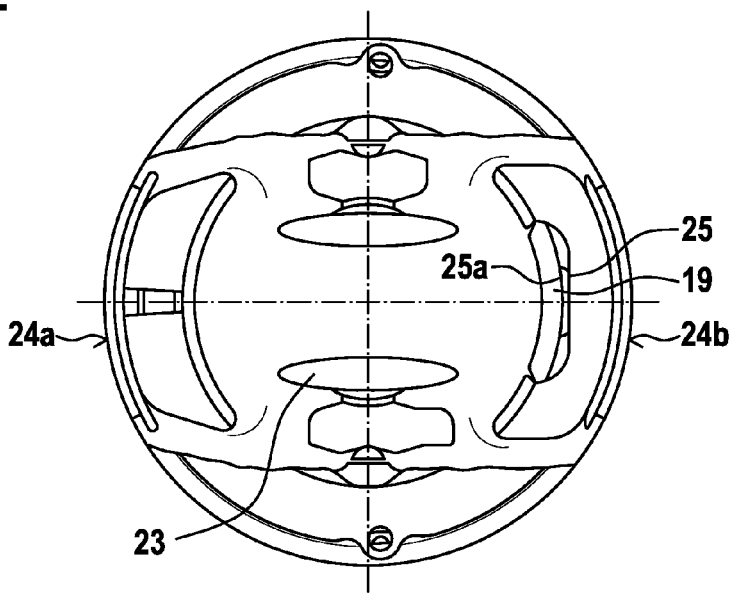
FIG. 2 shows an illustration of the underside of the piston in the direction of the arrow P according to FIG. 1, FIGS. 3*a*-3*c* show one exemplary embodiment of a sub-assembly according to the invention with a piston according to FIG. 1 during a piston stroke during engine operation.

FIGS. 1 and 2 show one exemplary embodiment of a piston 10 for a sub-assembly 100 according to the invention. The piston 10 can be a single-piece cast or forged piston or a multiple-piece constructed piston. The piston 10 can be manufactured from an iron-based material and/or a light alloy material.

FIGS. 1 and 2 show by way of example a single-piece box-type piston 10 with a cooling channel 17 which is open toward the bottom and is closed by way of a separate closure element 18, and with a thermally decoupled piston skirt 21.

The piston 10 has a piston head 11 with a piston crown 13 which has a combustion bowl 14, a circumferential firing land 15, and a circumferential ring part 16 with ring grooves for receiving piston rings (not shown). A circumferential cooling channel 17 is provided at the level of the ring part 16, which cooling channel 17 is configured so as to be open toward the bottom and is closed by way of a separate closure element 18 which has at least one feed opening 19 for cooling oil.

Furthermore, the piston 10 in the exemplary embodiment has a thermally decoupled piston skirt 21 with piston bosses 22 and boss bores 23 for receiving a gudgeon pin (not shown). The piston bosses 22 are connected in a manner known per se via boss attachments to the piston head 11. The piston bosses 22 are connected to one another via running surfaces 24*a*, 24*b*.

In the interior of the piston 10, the piston crown 13 has an underside 13*a* which is provided according to the invention with a jet divider 25. The jet divider 25 is arranged in the vicinity of the at least one feed opening 19 for cooling oil and has a substantially V-shaped cross section in the exemplary embodiment. Starting from the center axis M of the piston 10, the edge 25*a* of the jet divider 25 is oriented toward the outside in the direction of the cooling channel 17.

In the exemplary embodiment, the jet divider 25 is configured in one piece with the underside 13*a* of the piston crown 13 and has a first guiding face 26 and a second guiding face 27 for cooling oil. In the exemplary embodiment, the first guiding face 26 merges substantially continuously into an inner wall 17*a* of the cooling channel 17. In the exemplary embodiment, the second guiding face 27 merges substantially continuously into the underside 13*a* of the piston crown 13.

Figure 3A:
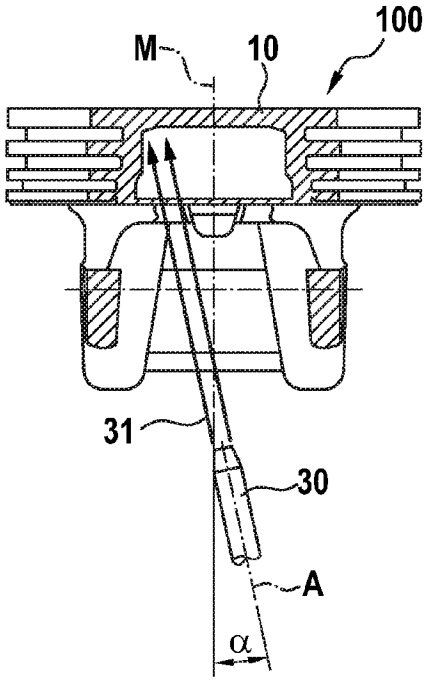
Figure 3B:
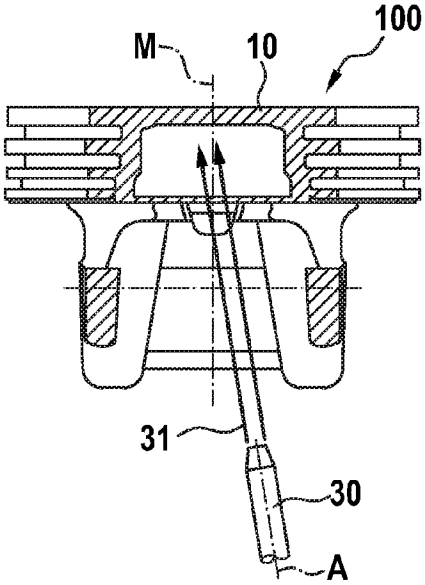
Figure 3C:
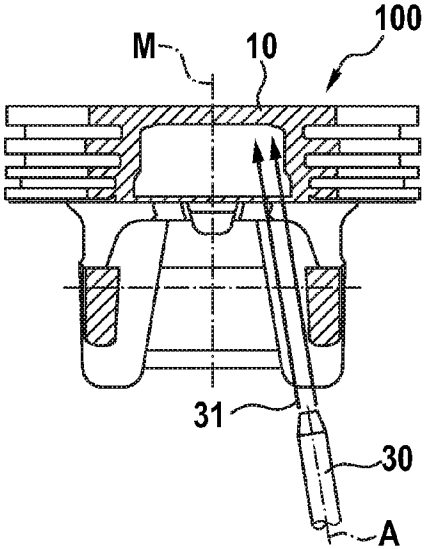

FIGS. 3*a* to 3*c* and 4 show a sub-assembly 100 according to the invention in different stages of engine operation with a piston 10 according to FIGS. 1 and 2 and an injection nozzle 30 for cooling oil, from which a cooling oil jet 31 exits. Here, FIG. 3*a* illustrates the situation at the top dead center, whereas FIG. 3*c* illustrates the situation at the bottom dead center. FIG. 3*b* represents the situation in a middle stroke position between the top dead center and the bottom dead center. The injection nozzle 30 is arranged fixedly in the crankcase in such a way that it is directed onto the jet divider 25.

In the exemplary embodiment, the center axis A of the injection nozzle 30 is arranged in such a way that it encloses an acute angle $\alpha$ with the center axis M of the piston 10. As a consequence, the piston 10 crosses the cooling oil jet 31 in each case once during one complete stroke movement from the top dead center to the bottom dead center and vice versa. The cooling oil jet 31 enters directly into the cooling channel 17 in each case at the top and bottom dead center, said cooling oil jet 31 being guided past the jet divider 25. In the respective middle stroke position between the top and the bottom dead center, the cooling oil jet 31 strikes the jet divider 25 with the result that, as shown on an enlarged scale in FIG. 4, one part 31*a* of the cooling oil jet 31 is steered in the direction of the underside 13*a* of the piston crown 13, that is to say in the direction of what is known as the dome, whereas the remaining part 31*b* of the cooling oil jet 31 continues to enter into the cooling channel 17. In this way, the cooling of the underside 13*a* of the piston crown 13 is optimized.

Figure 4:
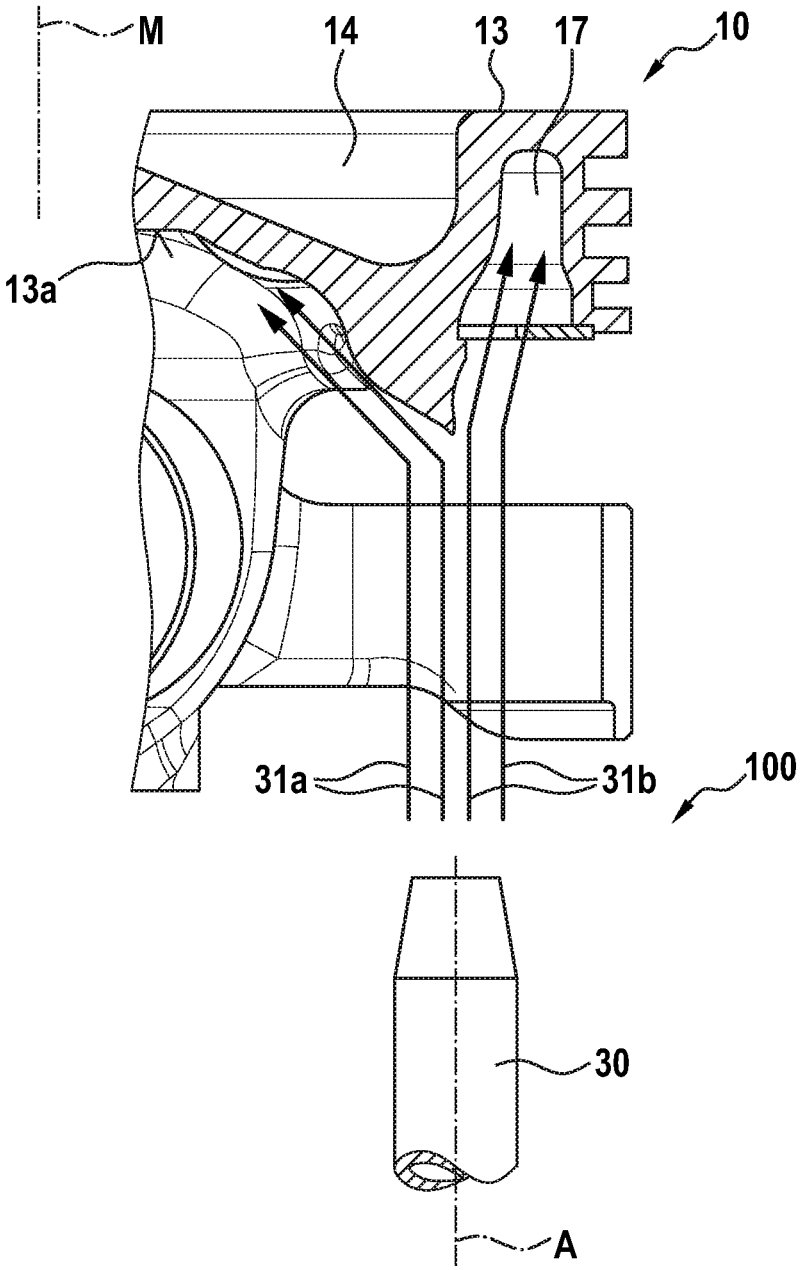
FIG. 4 shows the piston according to FIG. 1 during a stroke movement according to FIG. 3*b*.

It goes without saying that the injection nozzle 30 can also be arranged in such a way that its center axis A is oriented parallel to the center axis M of the piston 10, as indicated in FIG. 4. In this case, the cooling oil jet 31 is divided in each phase of the stroke movement of the piston 10 into two part jets 31*a*, 31*b* which are steered in each case onto the underside 13*a* of the piston crown 13 and into the cooling channel 17, respectively.

The invention claimed is:

1. A sub-assembly comprising a piston and an injection nozzle for cooling oil for an internal combustion engine, the piston having:

a piston skirt, a piston head having a piston crown with an underside, a circumferential ring part and, in the region of the ring part, a circumferential cooling channel with at least one feed opening for the cooling oil, and a jet divider for the cooling oil on the underside of the piston crown adjacent to the at least one feed opening, wherein the injection nozzle is arranged below the jet divider and is oriented toward the jet divider and with respect to the piston such that at top and bottom dead center positions, the oil jet enters directly into the cooling channel and past the jet divider, and in a middle stroke position, the oil jet strikes the jet divider such that a portion of the oil jet enters the cooling channel and another portion of the oil jet is steered in a direction of an underside of the piston crown.

2. The sub-assembly as claimed in claim 1, wherein a center axis of the injection nozzle is oriented parallel to a center axis of the piston.

3. The sub-assembly as claimed in claim 1, wherein a center axis of the injection nozzle encloses an acute angle with a center axis of the piston.

4. The sub-assembly as claimed in claim 1, wherein the jet divider has a substantially V-shaped cross section with an edge oriented in a direction from a center axis of the piston toward the cooling channel.

5. The sub-assembly as claimed in claim 1, wherein the jet divider is configured in one piece with the piston head.

6. The sub-assembly as claimed in claim 1, wherein the jet divider is configured as a separate component connected fixedly to the piston head.

7. The sub-assembly as claimed in claim 1, wherein the jet divider has a first guiding face and a second guiding face, the first guiding face being assigned to the cooling channel and the second guiding face being assigned to the underside of the piston crown.

8. The sub-assembly as claimed in claim 7, wherein the first guiding face merges continuously into an inner wall of the cooling channel.

9. The sub-assembly as claimed in claim 7, wherein the second guiding face merges continuously into the underside of the piston crown.

10. The sub-assembly as claimed in claim 1, wherein the piston is configured as a single-piece piston.

11. The sub-assembly as claimed in claim 1, wherein the piston consists of at least two components connected to one another.

12. The sub-assembly as claimed in claim 1, wherein the piston is configured as a box-type piston.

13. The sub-assembly as claimed in claim 1, wherein the cooling channel of the piston is configured as a closed cooling channel.

14. The sub-assembly as claimed in claim 1, wherein the cooling channel of the piston is configured as a cooling channel which is open toward the bottom and is closed by way of a closure element.

15. The sub-assembly as claimed in claim 14, wherein the piston has a thermally decoupled piston skirt.

16. A sub-assembly comprising a piston and an injection nozzle for cooling oil for an internal combustion engine, the piston having:

a piston skirt, a piston head having a piston crown with an underside, a circumferential ring part and, in the region of the ring part, a circumferential cooling channel with at least one feed opening for the cooling oil, and a jet divider for the cooling oil on the underside of the piston crown adjacent to the at least one feed opening, the jet divider having a first guiding face and a second guiding face, the first guiding face merging continuously into an inner wall of the cooling channel, and the second guiding face merging continuously into the underside of the piston crown, wherein the jet divider has a substantially V-shaped cross section with an edge oriented in a direction from a center axis of the piston toward the cooling channel, and wherein the injection nozzle is arranged below the jet divider and is oriented toward the jet divider and with respect to the piston such that at top and bottom dead center positions, the oil jet enters directly into the cooling channel and past the jet divider, and in a middle stroke position, the oil jet strikes the jet divider such that a portion of the oil jet enters the cooling channel and another portion of the oil jet is steered in a direction of an underside of the piston crown.

17. The sub-assembly as claimed in claim 16, wherein a center axis of the injection nozzle is oriented parallel to the center axis of the piston.

18. The sub-assembly as claimed in claim 16, wherein the piston is configured as a single-piece piston.

19. The sub-assembly as claimed in claim 16, wherein the jet divider is configured in one piece with the piston head.

20. The sub-assembly as claimed in claim 16, wherein the cooling channel of the piston is configured as a closed cooling channel.

* * * * *